United States Patent [19]

Rekewitz et al.

[11] Patent Number: 4,564,305

[45] Date of Patent: Jan. 14, 1986

[54] TRANSPORT DEVICE FOR MARGIN-PERFORATED FANFOLD PAPER AND FOR CONTINUOUS ROLL PAPER

[75] Inventors: Rudolf Rekewitz, Wolfratshausen; Hermann Wambach, Unterhaching, both of Fed. Rep. of Germany

[73] Assignee: Siemens Aktiengesellschaft, Berlin & Munich, Fed. Rep. of Germany

[21] Appl. No.: 484,979

[22] Filed: Apr. 14, 1983

[30] Foreign Application Priority Data

Apr. 20, 1982 [DE] Fed. Rep. of Germany ..... 3214549

[51] Int. Cl.[4] ..... B41J 11/50

[52] U.S. Cl. ..... 400/605; 271/9; 400/616.1; 400/637; 400/637.6; 400/636.3

[58] Field of Search ..... 400/616.1, 616.2, 616.3, 400/637, 605, 637.6, 636.3; 226/74, 76, 86; 271/9, 245, 246, 274

[56] References Cited

U.S. PATENT DOCUMENTS

| | | | |
|---|---|---|---|
| 2,171,003 | 8/1939 | Mabon | 400/616 X |
| 2,881,893 | 4/1959 | Metzner | 400/616 X |
| 3,186,325 | 6/1965 | De Belder | 271/246 X |
| 3,444,977 | 5/1969 | Kinney et al. | 400/616.1 X |
| 3,753,483 | 8/1973 | Lundquist et al. | 400/616.1 X |
| 4,042,091 | 8/1977 | Levinson et al. | 400/616.1 |
| 4,058,196 | 11/1977 | Rempel | 400/616.1 |
| 4,072,225 | 2/1978 | Manning et al. | 400/616.1 |
| 4,215,946 | 8/1980 | Nakabo et al. | 400/689 |
| 4,344,715 | 8/1982 | Van Horne et al. | 226/74 X |

FOREIGN PATENT DOCUMENTS

| | | | |
|---|---|---|---|
| 1085426 | 9/1980 | Canada . | |
| 1969336 | 6/1967 | Fed. Rep. of Germany . | |
| 8006325 | 3/1981 | Fed. Rep. of Germany . | |
| 57-91286 | 6/1982 | Japan | 400/616.1 |

OTHER PUBLICATIONS

IBM Technical Disclosure Bulletin, vol. 25, No. 1, Jun. 1982, pp. 202–203.

*Primary Examiner*—Edgar S. Burr
*Assistant Examiner*—Moshe I. Cohen
*Attorney, Agent, or Firm*—Hill, Van Santen, Steadman & Simpson

[57] ABSTRACT

A paper transport mechanism for data printers having powered platens includes a marginal perforation paper transport tractor upstream of the platen and a means for supplying unmargined perforated paper independent of the tractor to the platen, the platen having opposed pinch rollers, and means for adjusting the pinch force of the pinch rollers to accommodate either unperforated platen driven paper or perforated tractor driven paper.

6 Claims, 1 Drawing Figure

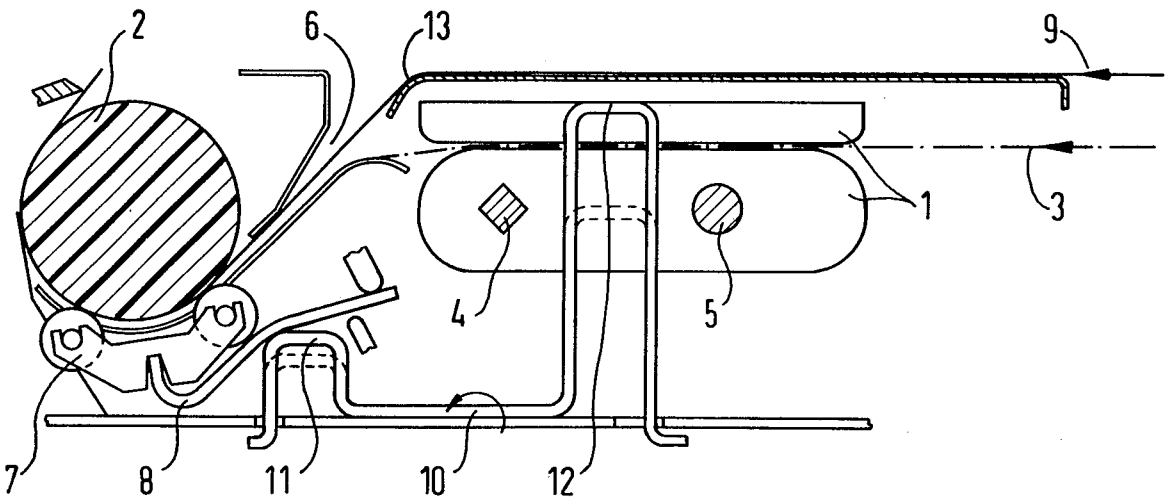
9
3
1
5
12
4
10
13
6
11
2
8
7

TRANSPORT DEVICE FOR MARGIN-PERFORATED FANFOLD PAPER AND FOR CONTINUOUS ROLL PAPER

BACKGROUND OF THE INVENTION

1. Field of the Invention

This invention relates to paper transport devices for use in data printers and more particularly to a device capable of being used with margin perforated paper and with unperforated paper.

2. Prior Art

Various types of paper, for example, margin perforated fanfold paper and continuous roll paper, are utilized as the recording carrier for the written output of data and text in printers of the type employed in businesses and offices. The transport devices normally utilized for such data printers differ respectively dependent upon the type of paper employed.

For example, when margin perforated fanfold paper is utilized, transport is frequently by means of tractor drive assemblies which employ driven endless belts equipped with projecting pins which engage both sides of the paper with the pins indexing in the marginal perforations. An opposed flap may be utilized which is pivoted towards and away from the belt to maintain the margin perforations in engagement with the pins of the driving belt. Such margin perforated paper, which is normally provided in fanfold stacks, may be either single sheet or multi-sheet, and is generally used in connection with tractor drives where the tractor drive is positioned on the exit or downstream side of the print zone of the data printer.

On the other hand, continuous roll paper or unmargin perforated paper is normally moved through the data printer in a standard manner by a friction drive between a power rotated platen and opposed pin rollers acting as pinch rollers.

Change of paper has therefore normally required a change in the drive mechanism which is most frequently obtained by the expensive expedient of utilizing different data printers equipped with differing drive systems. It would therefore be an improvement in the art to provide a single data printer having a compound drive system utilizable with either margin perforated tractor driven paper or with continuous roll or non-perforated platen driven paper.

SUMMARY OF THE INVENTION

It is therefore a principal object of this invention to provide a transport device with which both margin perforated paper and continuous roll paper can be transported through the print station of an output data printer.

This principal object is achieved by means of this invention in that a compound transport device is provided for feeding both margin perforated tractor driven and continuous roll platen driven paper to the print station. Margin perforated paper is driven by a tractor drive mechanism positioned upstream of a powered platen which is adjacent the print station. A friction drive is provided for non-perforated paper by means of pin rollers acting as opposed pinch rollers to the power driven platen. A lever actuatable means is provided for adjusting the pinch pressure of the pin rollers in order to provide a friction drive for use with the non-perforated paper and to allow a slip drive between the pin rollers and the platen when tractor driven perforated margin paper is utilized.

A significant advantage of this invention is that only one data printer will be employed for both fanfold paper, continuous roll paper and even for multi-ply continuous roll paper or multi-ply fanfold paper.

A further distinct advantage to the invention is that it enables a particularly compact form of data printer as a result of placing the tractor drive upstream of the platen.

It is also an advantage of this invention that disruptions in the forward feed of the various paper types will be substantially eliminated due to the variable pressure force of the friction drive at the platen.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE DRAWINGS

The FIGURE is a fragmentary sectional substantially schematic representation of a paper transport system for a data printer according to this invention.

DESCRIPTION OF THE PREFERRED EMBODIMENT

The FIGURE illustrates only those portions of a data printer relating to the paper feed which are necessary for an understanding of the present invention. As schematically shown, a standard tractor drive 1 of the pin type is positioned upstream of a platen 2. The pin drive usually consists of two belt systems arranged at the margins of the paper for engagement with the marginal perforations of the paper 3 to drive the shaft. The tractor drive is driven by a drive shaft 4 which in turn is operated by a motor and gearing (not shown). The tractor drive is movable along the axial length of the drive shaft so as to accommodate different paper widths. A guide shaft 5 is provided to stabilize the tractor drive. It will be understood that an opposed flap, shown at the top of the tractor drive 1 in the figure, maintains the paper in engagement with the pins of the drive belt, the flap being pivotable to allow the paper to be inserted and withdrawn.

Also utilized in this invention is a standard power platen 2 also driven by motor and gearing (not illustrated).

The chosen paper, whether the margin perforated paper 3 or unperforated paper 9, is guided to the platen area by means of a guide channel 6 and is fed between the powered platen 2 and a pin roller assembly 7 which is spring urged against the platen outer diameter by means of a spring 8. Preferably, the platen is power driven irrespective of the type of paper employed. However, in the case of tractor driven paper supplied from the tractor drive 1, the friction drive between the power platen and the pin roller 7 is to be such as to provide a slip between rotation of the platen and movement of the paper. In this manner, it will be assured that margin perforated paper will be driven without disruption, such as paper jamming, even though the paper transport 1 is positioned upstream of the platen.

The pressure force by which the pin rollers 7 are pressed against the platen 2 is made adjustable such that the pressure utilized when using margin perforated paper will be great enough to assure that the paper is transported but not so large as to exert too great a pull on the paper which would otherwise cause malfunctions to occur at the paper tractor 1.

When continuous roll paper or unmargined perforated paper 9 is utilized, the force with which the spring 8 presses the pin rollers against the platen is to be increased since, in this instance, substantially all movement of the paper 9 is controlled by the friction drive at the platen 2. This is particularly important in those instances where the paper 9 is being unwound from a remote supply roll (not illustrated) solely by reason of the friction drive at the platen.

In the embodiment illustrated, the spring pressure 8 can be adjusted between two stages. For example, the spring 8 can be of the type having an intermediate fulcrum affecting the spring with one end of the spring engaging the pin roller carriage and the opposite end being received in a retaining fixture. In such instances, a lever member 10 having a first lever arm 11 engageable with the spring and a second lever arm 12 can be utilized. Such a lever may, for example, be movable axially of the platen 2 and drive shaft 4 and have two projecting arm heights. The first projecting height being illustrated by the solid line portions at 11 and 12 and the second projecting height, axially spaced from the first projecting height, being shown by the dotted line portions of the drawing.

In the position for utilization with marginal perforated paper, the lever mechanism 10 is shifted to where the broken line portion underlies the spring 8 thereby substantially reducing the spring pressure against the pin rollers. In such instance, the broken line portion of the lever part 12 will underlie the tractor drive 1, therefore allowing the tractor drive to operate without obstruction. In this positioning, the pinch pressure between the pin rollers 7 and the platen 2 will be at a minimum or, provide even a slight clearance. In such an instance, a slip condition can occur between the paper 3 and the platen 2 which, however, will preferably still apply some movement force to the paper 3, the primary control of the paper however residing at the tractor drive 1.

When non-margin perforated paper 9 is to be used, the lever 10 can be shifted to where the solid line portion of the lever arm 11 will engage the spring 8 increasing the pinch force at the nips between the pin rollers 7 and the platen 2. In this position, the lever portion 12 may project upwardly into the paper track for the margin perforated paper 3 and thereby block movement of the margin perforated paper. In this position, continuous roll or non-margin perforated paper 9 can be transported disruption free into the guide area 6 over a guide plate 13 positioned above the tractor drive 1. Movement of the paper 9 will be only by means of the friction drive of the platen.

It will be appreciated that by providing a multiple lever 10 which both affects spring pressure at the nip between the pin rollers 7 and the platen 2 and affects the tractor drive 1, incorrect operation of the system can be substantially prevented. When in the first position, illustrated by the solid line, the portion 12 of the lever 10 will block activation of the tractor drive 1 and will increase pinch pressure to provide friction drive of the paper 9. In the second position, illustrated by the broken lines, the tractor drive 1 will be free to control movement ot the paper 3, however, the pinch pressure will be reduced to a slip pressure which may be inadequate to move the paper 9, thereby assuring that only margin perforated tractor driven paper will be moved through the guide zone into the platen area.

It will therefore be appreciated that this invention provides an improved paper transport mechanism for data printers capable of being used either with margin perforated tractor drive paper or with continuous roll or unmargin perforated paper. A pin tractor drive is provided upstream of a power driven platen, the platen being associated with opposed spring urged pinch rollers to provide a platen friction drive. Lever means are provided for adjusting the spring force of the pinch roller between a paper slip friction drive for use with margin perforated paper primarily advanced by the tractor drive and a substantially slip free higher friction drive for use with nontractor driven paper. In the preferred embodiment, selection of the pinch roller pressure will enable or disable operation of the tractor drive.

Although the teachings of our invention have herein been discussed with reference to specific theories and embodiments, it is to be understood that these are by way of illustration only and that others may wish to utilize my invention in different designs or applications.

We claim as our invention:

1. A transport device for data printers utilizing both margin perforated paper and non-margin perforated paper comprising a tractor drive means positioned upstream of a powered platen, a pinch roller assembly associated with said platen for feeding paper around said platen by friction drive, said paper being insertable between the pinch rollers and the platen, means for forceably urging said pinch rollers toward said platen, and means for adjusting the urging force without withdrawing said pinch rollers from said paper, said means for adjusting providing a first pinch force for non-perforated paper and a second, lesser positive pinch force for tractor driven perforated paper.

2. A device according to claim 1, wherein the means for urging includes a spring.

3. A device according to claim 2, including a lever means, said lever means having a first and a second portion, said lever means movable with respect to said platen and said tractor drive between first and second positions, said first portion of said lever means operatively engaging said spring means when in said first position to increase the pressure of the pinch rollers against the said platen when said lever is in said first position, said second portion preventing operation of said tractor drive when said lever is in said first position, said first portion in said second position being operatively disengaged from said spring, and said second portion in said second position being operatively disengaged from said tractor drive.

4. A device according to claim 3, wherein said second portion blocks the paper track through the tractor drive when the lever is in said first position.

5. A paper transport mechanism for data printers comprising a power driven platen, a platen opposed pinch roller assembly, means for applying a force to said pinch roller assembly for urging said pinch roller assembly against said platen, paper guide means for guiding paper to the nip area between the pinch roller assembly and the platen on an upstream infeed side of said nip area, a marginal perforation paper tractor drive positioned upstream of said platen for supplying, under positive drive, margin perforated paper to said guide means, means for supplying unperforated paper to said guide means independent of said tractor drive, means for adjusting said means for applying a force without withdrawing said pinch rollers from said paper, said means for adjusting providing a first force for use in connection with tractor drive supplied perforated margin paper and a second force for use with non-tractor drive supplied paper, said first force being a positive force less than said second force and allowing slip to occur between said paper and said platen.

6. The device of claim 5, wherein said means for adjusting said force includes means for blocking paper transport through said tractor drive when said second force is selected.

* * * * *